US006328582B1

(12) United States Patent
Fukamachi

(10) Patent No.: US 6,328,582 B1
(45) Date of Patent: Dec. 11, 2001

(54) LATCHED ELECTRICAL CONNECTOR

(75) Inventor: Makoto Fukamachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/552,311

(22) Filed: Apr. 19, 2000

(30) Foreign Application Priority Data

Apr. 19, 1999 (JP) ..... 11-110903

(51) Int. Cl.[7] ..... H01R 13/62
(52) U.S. Cl. ..... 439/157; 139/489; 139/352
(58) Field of Search ..... 439/157, 160, 439/352, 489

(56) References Cited

U.S. PATENT DOCUMENTS

| | | | | |
|---|---|---|---|---|
| 5,172,998 | | 12/1992 | Hatagishi | 439/296 |
| 5,178,553 | | 1/1993 | Hatagishi | 439/157 |
| 5,238,417 | | 8/1993 | Hatagishi | 439/153 |
| 5,562,465 | * | 10/1996 | Taguchi et al. | 439/157 |
| 5,672,068 | * | 9/1997 | Tsuchiya et al. | 439/157 |
| 5,910,028 | * | 6/1999 | Tsuji | 439/489 |
| 6,012,933 | * | 1/2000 | Katsuma | 439/157 |
| 6,019,618 | * | 2/2000 | Nakata | 439/157 |
| 6,126,480 | * | 10/2000 | Kawase et al. | 439/489 |

* cited by examiner

*Primary Examiner*—Renee Luebke
*Assistant Examiner*—Briggitte R. Hammond
(74) *Attorney, Agent, or Firm*—Banner & Witcoff, Ltd.

(57) ABSTRACT

A connector in which the pivoting of a lever to a correct position can be used to detect whether male and female housings are in a fully fitted state.

When a lever 30 is pivoted to a correct position, a stopping protrusion 40 fits with a lever stopping member 14 of a female housing 10, thereby causing the female housing 10 and a male housing 20 to fit completely together. When the lever 30 reaches the final position, releasing members 42 of the lever 30 push down arms 59 of a detecting member 50 attached in a groove 13 of the female housing 10, thereby releasing stopping members 60 of the arms 59 from an engaged state against regulating members 18 which protrude from side faces of the groove 13. As a result, the detecting member 50 can be pushed in an anterior direction. This movement of the detecting member 50 allows one to detect that the two housings 10 and 20 have been correctly fitted together. Furthermore, if the detecting member 50 cannot be moved, it can be detected that the two housings 10 and 20 are in a half-fitted state.

10 Claims, 7 Drawing Sheets

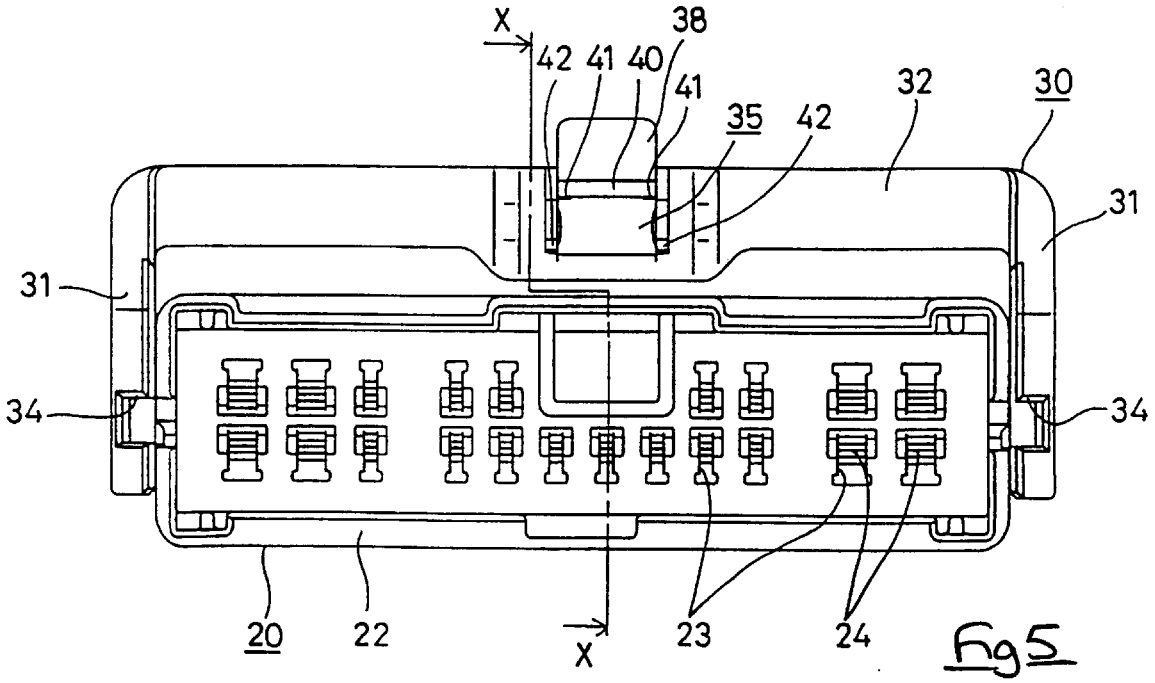
Fig5
Fig6
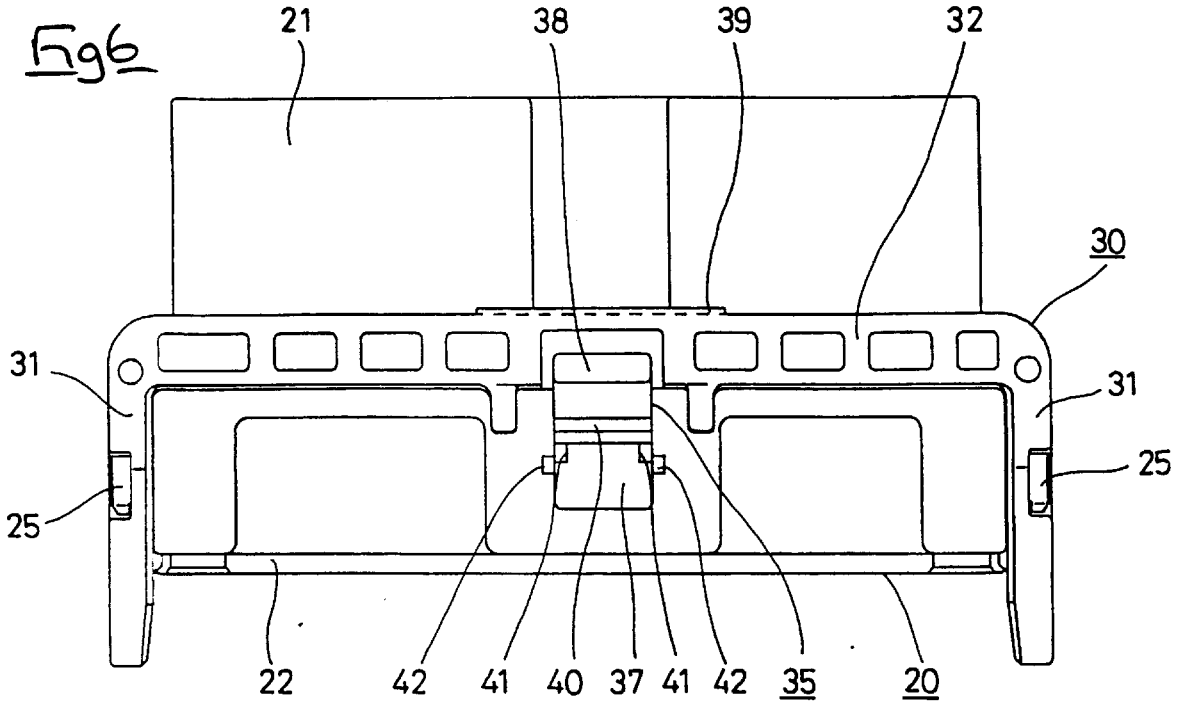

LATCHED ELECTRICAL CONNECTOR

TECHNICAL FIELD

The present invention relates to a lever-type electrical connector.

BACKGROUND TO THE INVENTION

In order to facilitate the fitting together of a pair of male and female housings of an electrical connector, one of the two housings is provided with a pivotable lever. A cam groove is provided on the lever in order to guide a corresponding housing, and a pin protrudes from the corresponding housing, this pin being inserted into the cam groove. When the two housings are to be fitted together, the lever is pivoted with the pin in an inserted state within the cam groove. When the lever reaches the final position, the two housings are completely drawn together.

However, the operator may believe that the two housings are completely fitted even though the lever has not reached the final position, and may stop pivoting the lever part-way through the operation. In that case, the two housings will remain in a half-fitted state.

The present invention has taken the above problem into consideration and aims to present a connector in which the operation of rotating the lever to the correct position can be used to detect whether the pair of male and female housings are in the fully fitted state.

SUMMARY OF THE INVENTION

According to the invention there is provided a lever type electrical connector comprising male and female connector housings adapted for mutual engagement, one of the connector housings having a lever engageable with the other connector housing and latchable thereto by first latch means provided on the housings, said lever being pivotable from an open to a closed position to draw said housings together, characterised in that one of said housings further includes a detecting member movable thereon from a first position to a second position. said detecting member having a resilient arm engageable with an abutment of said one of said housings in an open condition of said lever, said lever further including a releasing member adapted to bend said resilient arm in the closed position of said lever, thereby to release engagement of said arm and abutment and to permit movement of said detecting member to the second position.

The detecting member of the invention permits a half-fitted state to be readily detected since the detecting member can only be moved to the second position when the lever is in the closed condition.

Preferably symmetrical resilient arms are provided on the detecting member, these arms being engageable with abutments of one of the housings, but adapted to be deflected out of such engagement on movement of the lever to the closed condition.

In a preferred embodiment the detecting member protrudes in the first position.

The detecting member may include additional latch means to engage and hold the lever in the closed condition when the detecting member is moved to the second position.

In the preferred embodiment a resilient latch is provided to retain the lever in the closed position. and a resilient latch is also provided to retain the detecting member in the second position. Such latches are conveniently moulded in resilient plastics material and typically comprise a resilient arm engageable with a recess or protrusion of a relatively fixed component, which in the preferred embodiment is one of said housings.

BRIEF DESCRIPTION OF DRAWINGS

One feature of the invention will be apparent from the following description of a preferred embodiment shown by way of example only in the accompanying drawings in which:

FIG. 5 is a front elevation of a male housing;

FIG. 6 is a plan view of the male housing;

DESCRIPTION OF A PREFERRED EMBODIMENT

An embodiment of the present invention is described below with the aid of FIGS. 1 to 13. Connectors of the present embodiment are a female connector housing 10, shown on the right in FIG. 1, and a male connector housing 20, shown on the left. The two housings 10 and 20 are mutually fitted together by pivoting a lever 30 provided on the male housing 20. The fitting faces of the two housings 10 and 20 are considered to be their anterior sides.

Figure 2:
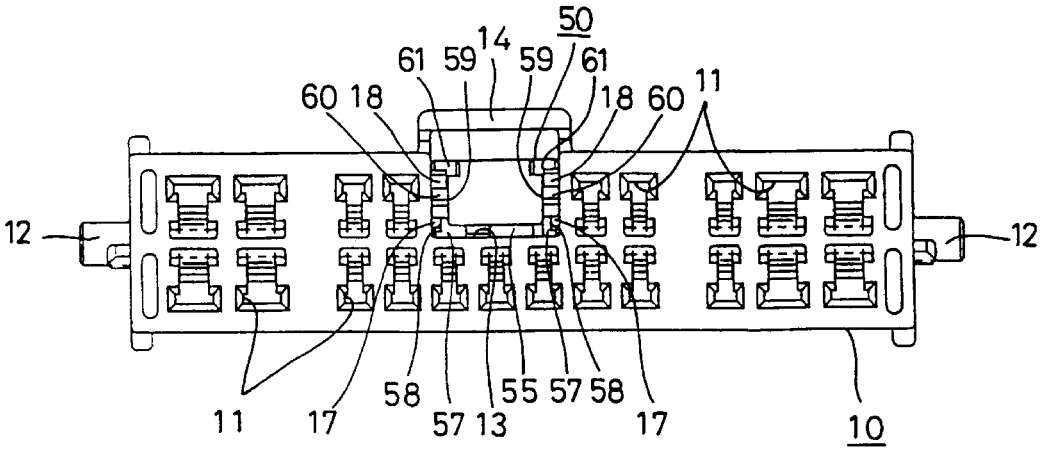
FIG. 2 is a front elevation of a female housing.

This female housing 10 is block-like. As shown in FIG. 2, a plurality of cavities 11 are provided therein, these cavities 11 being aligned in a width-wise direction and forming an upper row and a lower row. A female terminal fitting (not shown) is inserted in each of these cavities 11. Prescribed stopping mechanisms maintain the female terminal fittings within the cavities 11. Follower pins 12 protrude from both side faces of the female housing 10, cam grooves 34 of the lever 30 fitting therewith.

Figure 1:
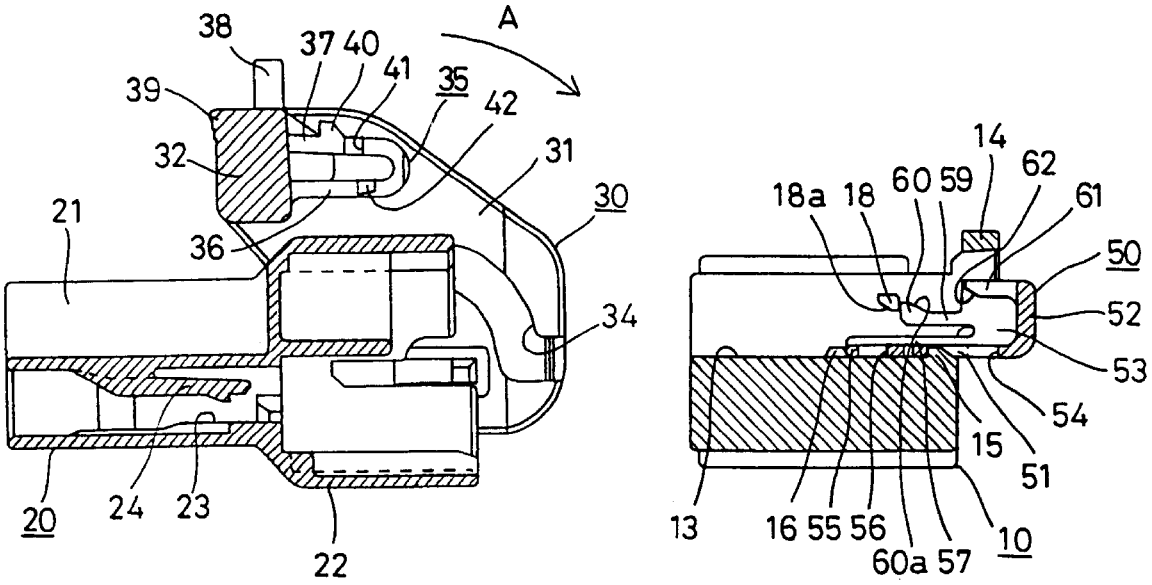
FIG. 1 is a cross sectional view along the line X—X (FIG. 5) of a connector of a first embodiment, prior to being fitted together.
Figure 3:
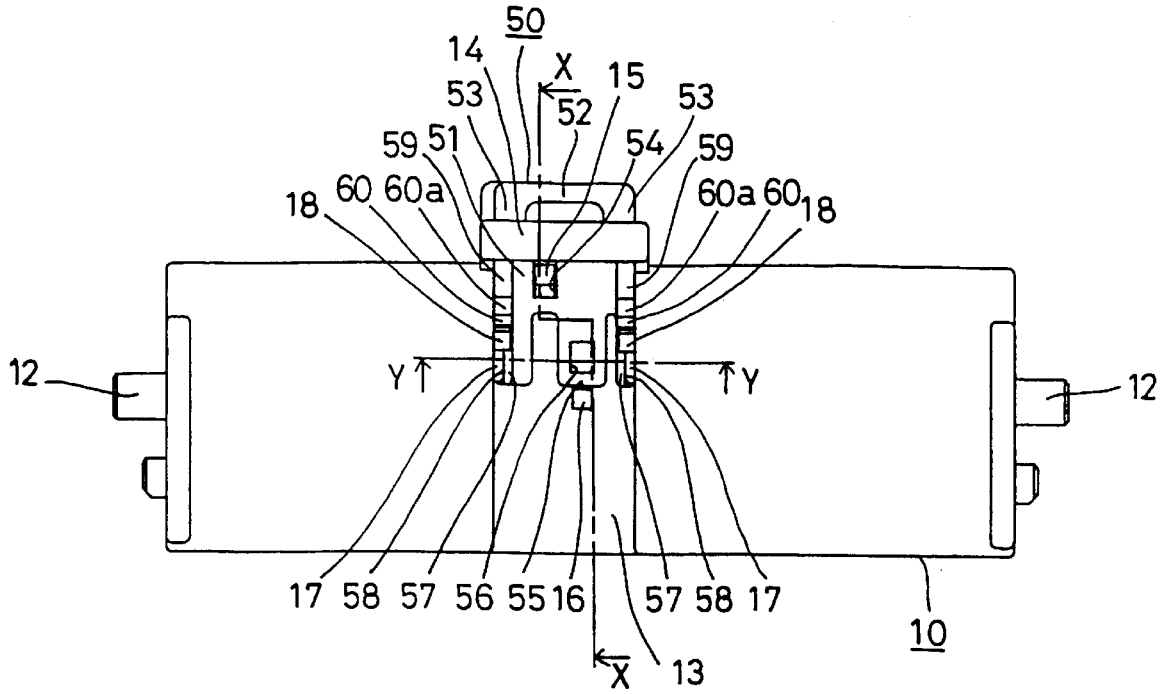
FIG. 3 is a plan view of the female housing.

As shown in FIG. 1 to FIG. 3, a groove 13 is provided in the central region, in a width-wise direction, of an upper face of the female housing 10. This groove 13 is open in an anterior-posterior direction. The depth of groove 13 is approximately half the height of the female housing 10. A lever stopping member 14 is provided at a posterior end of this groove 13. This lever stopping member 14 straddles the groove 13 and latches the lever 30. A detecting member 50, one of the components of the present invention is attached to the posterior end of the groove 13. The configuration of the groove 14 and the detecting member 50 will be explained in detail below.

As shown in FIG. 1, the male housing 20 has a configuration whereby an anterior end of an approximately block-like terminal housing member 21 is provided with a hood 22 which fits around the female housing 10. Cavities 23 are provided within the terminal housing member 21, the position of these cavities 23 corresponding with the cavities 11 of the female housing 10. Each of these cavities 23 is capable of housing a male terminal fitting (not shown). A lance 24 is formed at an upper face of each cavity 23, these lances 24 engaging respective male terminal fittings and retaining them in a latched state.

The lever 30 mentioned above is installed on the male housing 20. As shown in FIG. 5, this lever 30 has an inverted U-shape and comprises a pair of arms 31 which connect with the two side faces of the hood 22, and a joining member 32 which joins these arms 31. As shown in FIG. 6, the two arms 31 are attached to axial protrusions 25 which protrude from both outer side faces of the hood 22. As shown in FIG. 1, the lever 30 can be pivoted in the direction of the arrow A using these axial protrusions 25 as pivot axes.

Figure 7:
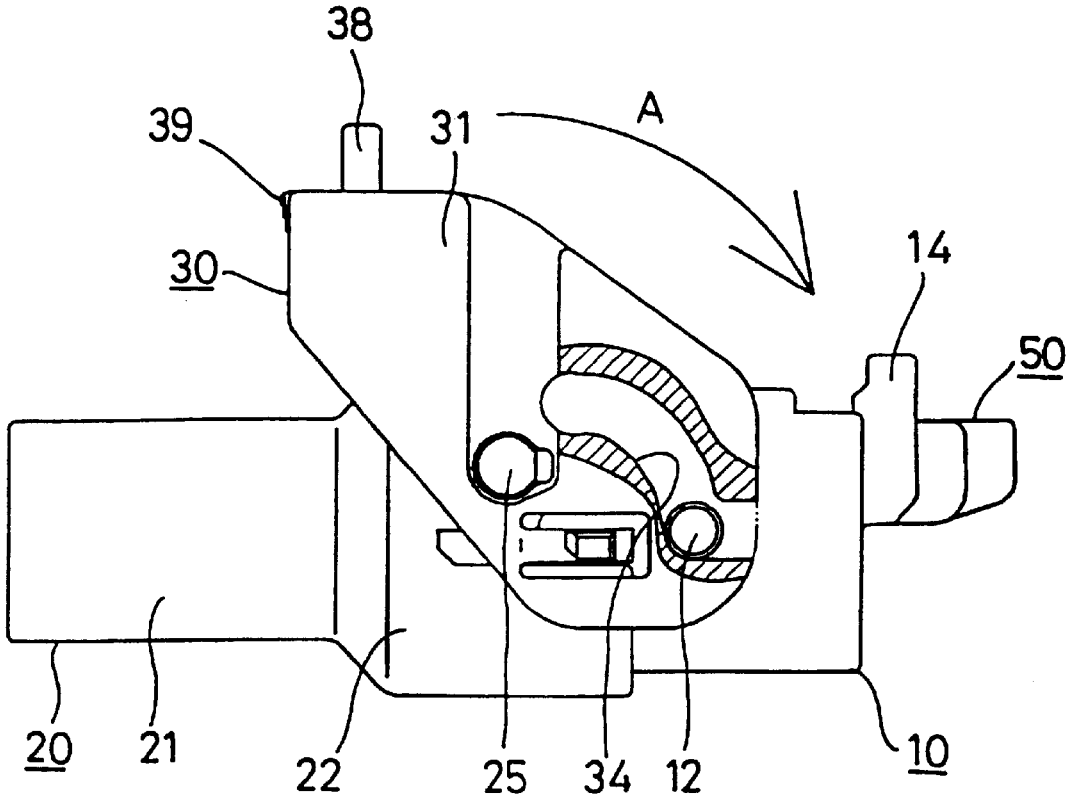
FIG. 7 is a partially cut-away side face view showing a pivoting operation of a lever.
Figure 8:
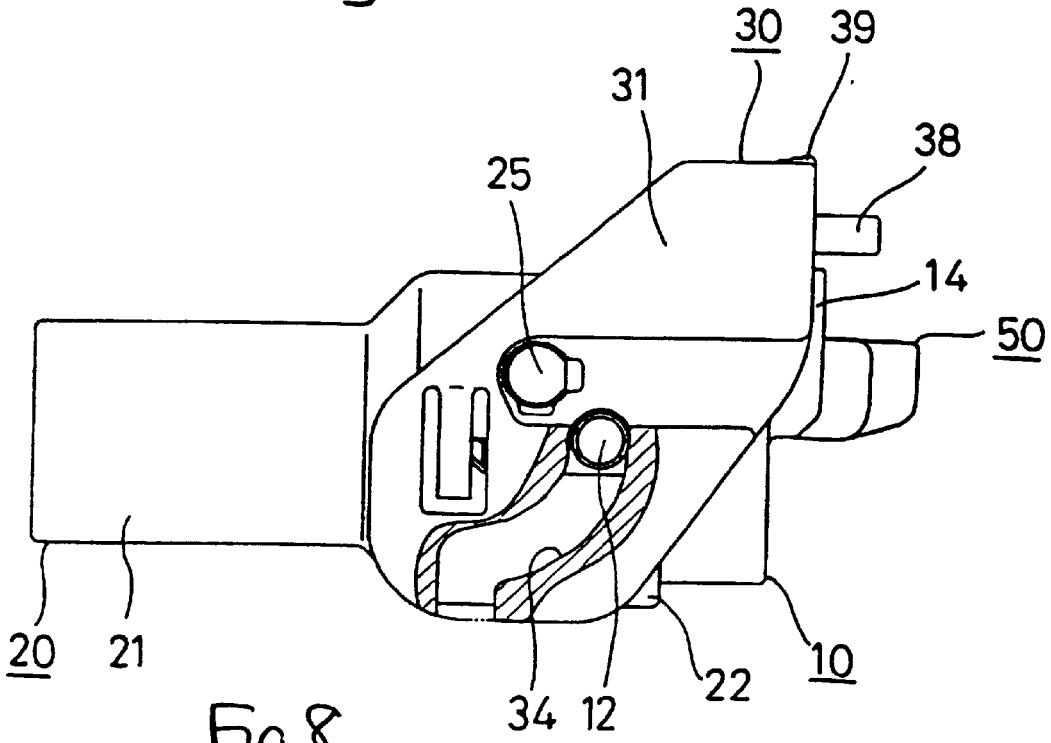
FIG. 8 is a partially cut-away side face view showing the lever in a state whereby it has been pivoted to a final position.

Cam grooves 34 are provided on the arm members 31, on faces which make contact with the hood 22. As shown in FIG. 1 and FIG. 7, these cam grooves 34 are provided with openings which face an anterior direction when the lever 30 is in a state prior to being pivoted. The follower pins 12 of the female housing 10 can be inserted from these openings and, as shown in FIG. 8, the follower pins 12 move along the cam grooves 34 while the lever 30 is being moved.

As shown in FIG. 1, when the lever 30 is in a state prior to being pivoted, a central portion of the joining member 32 of the lever 30 is open in a width-wise direction (towards the top in FIG. 1). A cantilevered resilient locking member 35 protrudes in an anterior direction from a joining portion of a lower side of this open portion. This resilient locking member 35 comprises a base end 36 extending directly in an anterior direction, and an arcuate portion 37. This arcuate portion 37 turns in a U-shape from an anterior end portion of the resilient locking member 35 and extends parallel to the base end 36. Its tip turns upwards approximately at a right angle to form a protruding member 38 for a releasing operation. Furthermore, as shown in FIG. 6, an operating member 39. for effecting the operation of the lever 30. is attached to a portion of a posterior side of the protruding member 38.

Figure 10:
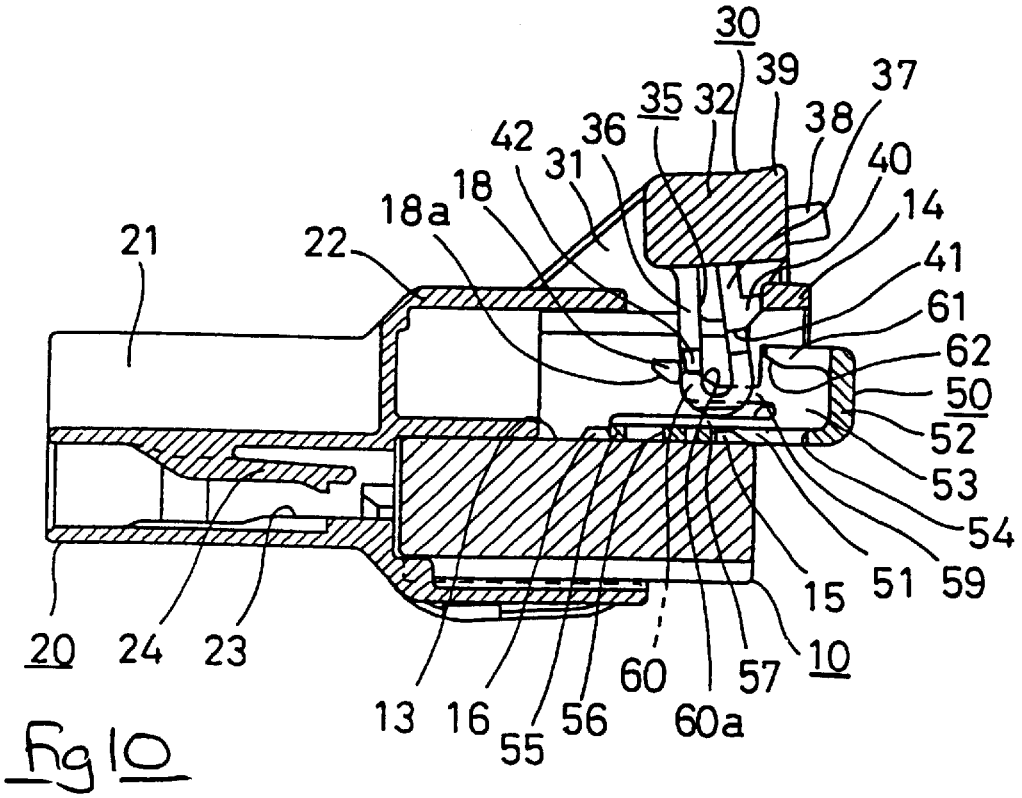
FIG. 10 is a cross-sectional view along the line X—X showing the lever in a state where it is being pivoted.
Figure 11:
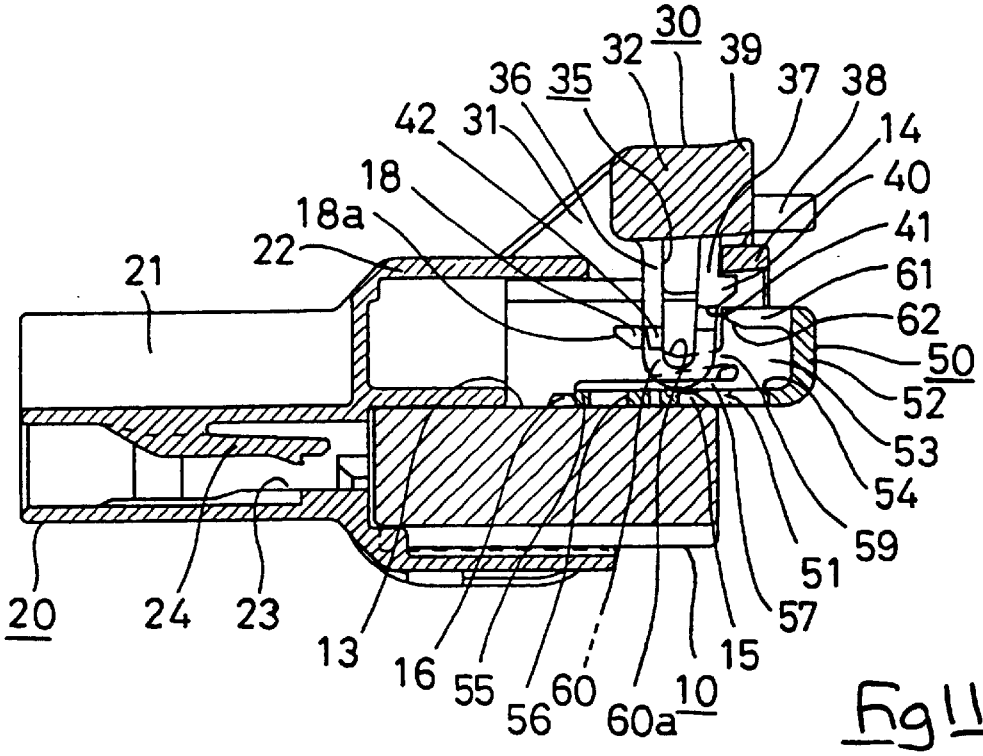
FIG. 11 is a cross-sectional view along the line X—X showing the lever in a state whereby it has been pivoted to a final position.

A stopping protrusion 40 is formed on an upper face (relative to FIG. 1) of the arcuate portion 37 of the resilient locking member 35. As shown in FIG. 10, an opening edge of the arcuate portion 37 of the resilient locking member 35 is capable of being bent so as to approach the base end 36 of the resilient locking member 35. As shown in FIG. 11. the stopping protrusion 40 is engaged against the lever stopping member 14 of the female housing 10 when the lever 30 has been pivoted. The lever 30 is in the final position when the stopping protrusion 40 and the lever stopping member 14 are engaged.

Stopping grooves 41 are formed to the anterior of the stopping protrusion 40 (relative to FIG. 1) at both side faces of the bent portion 37. When the lever 30 has been moved to the final position, hooking members 61 of the detecting member 50 (to be explained later) enter the stopping grooves 41 (see FIG. 12). Releasing members 42 protrude from both side faces of the base end 36. As the lever 30 is pivoted, these releasing members 42 interfere with arms 59 of the detecting member 50 (see FIG. 10). When the lever 30 has reached the final position, the two housing 10 and 20 are fully fitted together.

Figure 12:
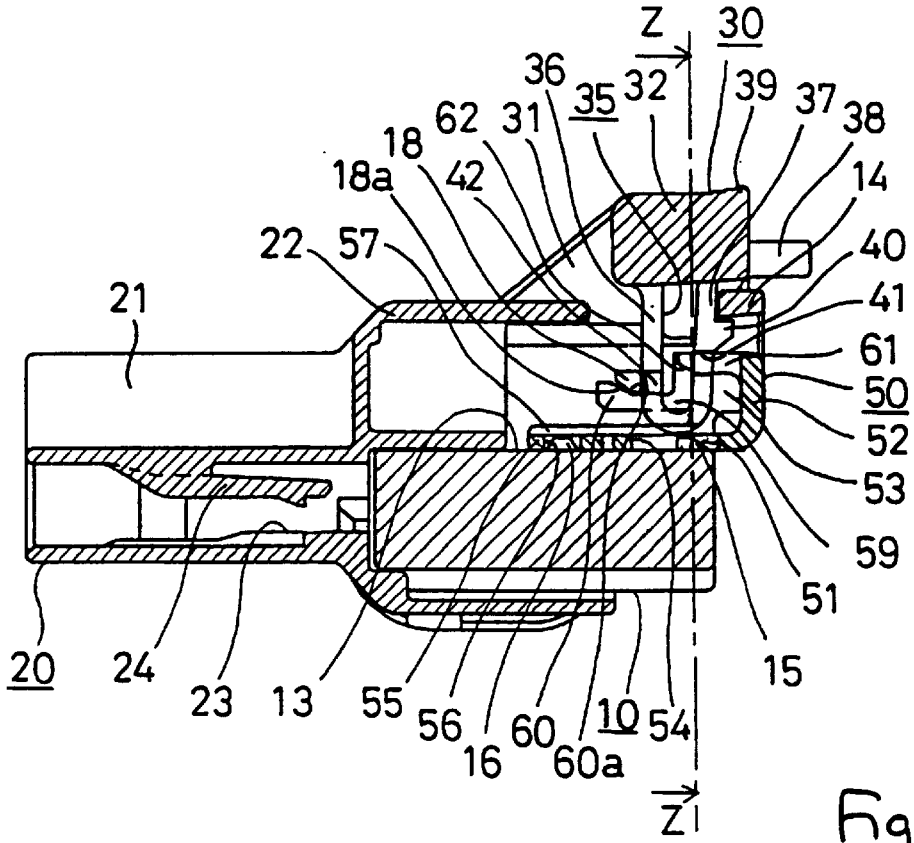
FIG. 12 is a cross-sectional view along the line X—X showing a detecting member in a state whereby it has been moved in an anterior direction.

Next the configuration of the detecting member 50 and the groove 13 is explained in detail. As shown in FIG. 1. the detecting member 50 is attached to a posterior end portion of the groove 13 in a state whereby it protrudes in a posterior direction from a posterior end face of the female housing 10. Further, a shown in FIG. 11, the detecting member 50 can be moved in an anterior direction from this initial attaching state into the groove 13. The position of the detecting member 50 after this movement is shown in FIG. 12.

As shown in FIG. 1, the detecting member 50 comprises a base 51 which extends along the bottom of the groove 13, a posterior wall 52 rising upwards from a posterior end face of the base 51. and side walls 53 which extend along both side edges of the base 51 these side walls 53 rising upwards at approximately a central portion of the base 51 and joining with the posterior wall 52. As shown in FIG. 3, a stopping hole 54 is provided in the base 51, this stopping hole 54 being long and narrow in an anterior-posterior direction. A posterior stopping protrusion 15 provided in the groove 13 fits with an anterior portion of this stopping hole 54, engaging against an anterior edge of the stopping hole 54 and thereby preventing unwanted movement of the detecting member 50 in a posterior direction. A bending member 55 of a prescribed width protrudes in an anterior direction from an anterior end of the base 51, an anterior end of this bending member 55 being provided immediately to the posterior of a locking protrusion 16 of the groove 13. A square locking hole 56 is provided in the centre of the bending member 55. As shown in FIG. 12, this locking protrusion 16 is engaged within the locking hole 56 when the detecting member 50 is pushed in an anterior direction.

Figure 4:
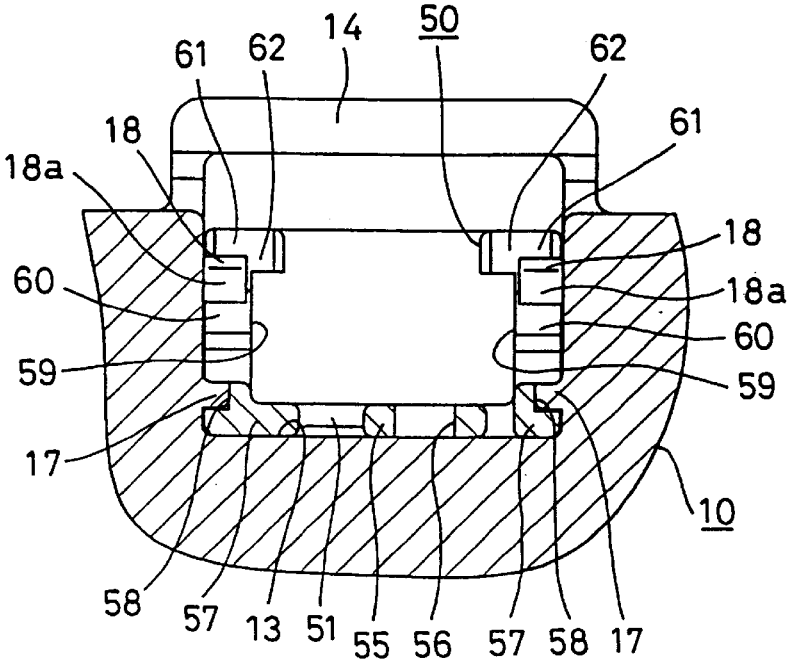
FIG. 4 is a cross-sectional view of the female housing along the line Y—Y of FIG. 3.

As shown in FIG. 3, a pair of guiding protrusions 57 protrude from anterior ends of both side edges of the base 51 of the detecting member 50, these guiding protrusions 57 having the same length as the bending member 55. As shown in FIG. 4, guiding grooves 58 which extend in an anterior-posterior direction are formed at side edges of the guiding protrusions 57. Guiding protruding members 17 formed on side faces of the groove 13 fit into these guiding grooves 58, thereby guiding the detecting member 50 when it is moved in an anterior-posterior direction. A pair of arms 59 are provided above and parallel to the guiding protrusions 57, these arms 59 extending from anterior ends of the two side walls 53.

The arms 59 are capable of bending in an up-down direction. As shown in FIG. 1, a stopping member 60 protrudes from an upper face on an anterior end portion of each arm 59. Anterior end faces of the stopping members 60 make contact with and engage against regulating members 18 which protrude from the side faces of the groove 13. The engaged state of the stopping members 60 and the regulating members 18 regulates the movement of the detecting member 50 in an anterior direction. In addition, tapered aces **60*a* are formed on posterior faces of the stopping members 60, these tapered faces 60*a* sloping downwards and towards the posterior. Tapered faces 18*a* having the same angle of inclination as the arms 59 are formed on anterior lower faces of the regulating members 18. These tapered faces 18 and 60*a* engage against each other after the detecting member 50** has been moved in an anterior direction.

Figure 13:
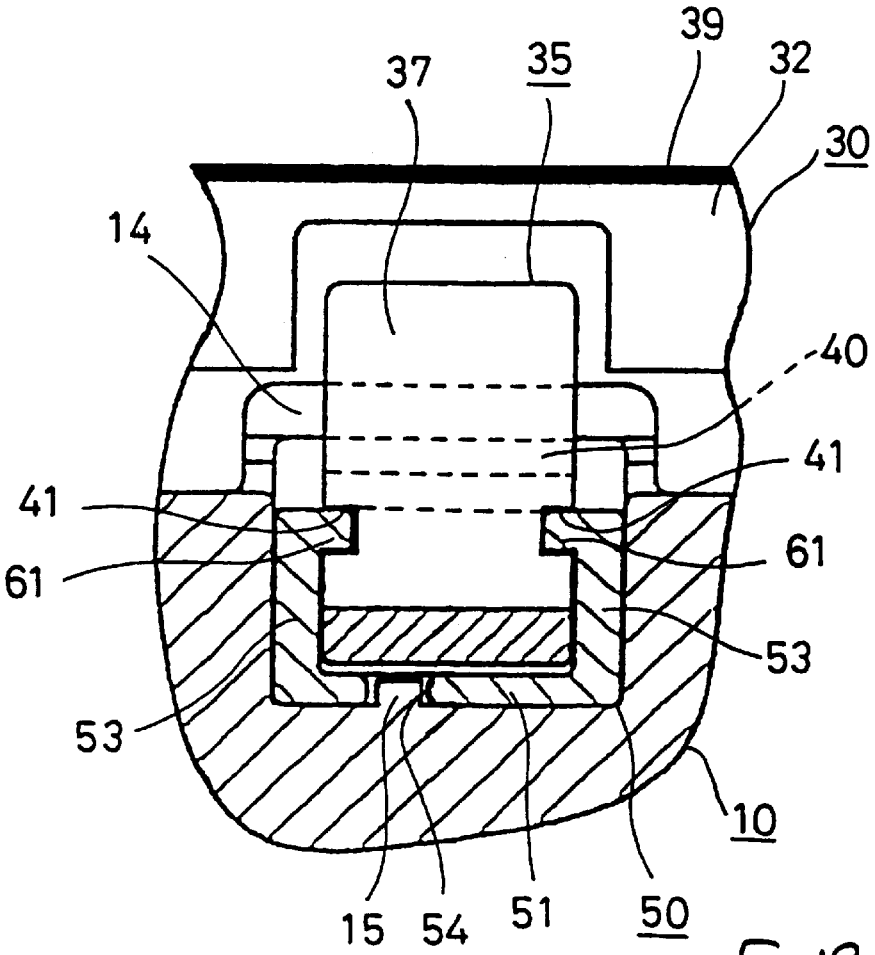
FIG. 13 is a cross-sectional view of FIG. 12 along the line Z—Z.

As shown in FIG. 4, pointed hooking members 61 protrude inwards from upper edges of the two side walls 53 of the detecting member 50. As shown in FIG. 1, anterior end portions of the hooking members 61 have a long and narrow shape, and lower faces of these anterior ends have tapered shape, the latter forming guiding members 62. When the lever 30 has been pivoted to the final position as shown in FIG. 13, the hooking members 61 enter the stopping grooves 41 of the resilient locking member 35 and are retained therein.

Figure 9:
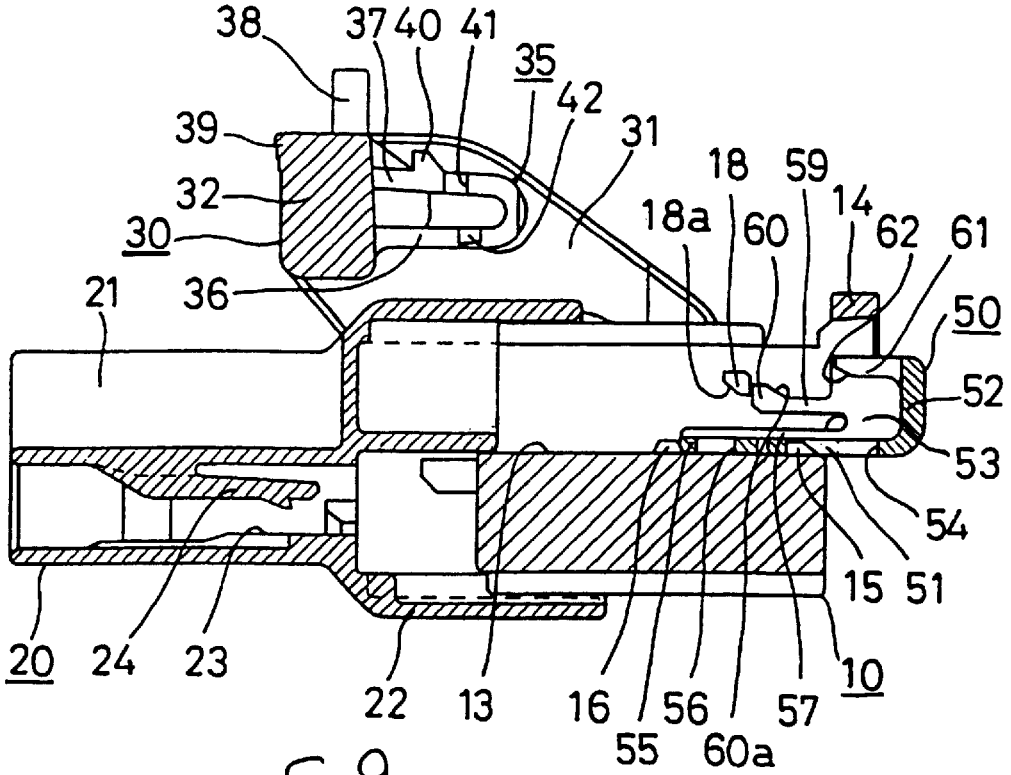
FIG. 9 is a cross-sectional view along the line X—X showing the two housings in a state where they are being fitted together.

The present embodiment is configured as described above. Next, the operation thereof will be explained. In order to fit the two housings 10 and 20 together, the lever 30 is positioned so that the openings of the cam grooves 34 face an anterior direction, as shown in FIG. 1. From this state, as shown in FIG. 9, the female housing 10 is fitted within the hood 22 and, as shown in FIG. 7, the follower pins 12 are inserted into the cam grooves 34 of the lever 30. Next. the operating member 39 of the lever 30 is pressed, thereby causing the lever 30 to move in the direction shown by the arrow A. As a result, a shown in FIG. 8, the follower pins 12 move along the cam grooves 34 and the two housings 10 and 20 approach each other.

As shown in FIG. 10, the pivoting of the lever 30 is accompanied by the stopping protrusion 40 pushing against the lever stopping member 14. At this juncture, the resilient locking member 35 receives a pushing force which causes it to bend, thereby causing an open end of the bent-over portion 37 to approach the base end 36. At the same time, the releasing members 42 which protrude from the side faces of the base end 36 make contact with upper faces of the arms 59, pushing these arms 59 and causing them to bend downwards.

As shown in FIG. 11, when the lever 30 is pivoted to the final position, the stopping protrusion 40 rises over the lever stopping member 14 and the resilient locking member 35 returns resiliently to its original shape, thereby engaging the stopping protrusion 40 against the lever stopping member 14. By this means, the movement of the lever 30 in a returning direction is regulated. Simultaneously, the arms 59 are pushed downwards by the releasing members 42 of the resilient locking member 35 to a height whereby the stopping members 60 and the regulating members 18 can be released from their mutually engaged state.

Next, as shown in FIG. 12, the detecting member 50 is pushed from the posterior end in an anterior direction. As the detecting member 50 moves, the arms 59 are pushed downwards by the releasing members 42, the stopping members 60 move below the regulating members 18, are released therefrom, and return resiliently to their original shape, and the tapered faces 60*a* of the stopping members 60 engage against the tapered faces 18*a* of the regulating members 18.

In addition, as shown in FIG. 13, the hooking members 61 enter the stopping grooves 41 of the resilient locking member 35 as the detecting member 50 moves. These hooking members 61 are retained therein, thereby regulating the movement of the lever 30 in a returning direction.

Furthermore, as shown in FIG. 12, the stopping hole 54 of the base 51 and the posterior stopping protrusion 15 of the groove 13 are released from their engaged state, the posterior stopping protrusion 15 comes to be located in the posterior portion of the stopping hole 54, and the bending member 55 bends and rises over the locking protrusion 16. Then the locking protrusion 16 fits into the locking hole 56 and is retained therein. The movement of the detecting member 50, which has been moved an anterior direction, is thereby regulated in an anterior-posterior direction. After being moved, the detecting member 50 protrudes less from the posterior end face of the female housing 10 than its protrusion before being moved.

In this manner, moving the detecting member 50 in an anterior direction allows one to detect whether the lever 30 has reached the final position and whether the two housings 10 and 20 have been correctly fitted together. If the detecting member 50 is pushed in when the lever 30 has not yet reached the correct position, the stopping members 60 of the arms 59 make contact with the regulating members 18 and regulate the anterior movement of the detecting member 50. Consequently, if the detecting member 50 cannot be pushed in, the two housings 10 and 20 are identified as being in a half-fitted state.

The two housings 10 and 20 may need to be separated for maintenance or the like. In that case, the detecting member 50 is first pushed in a posterior direction from the state shown in FIG. 12. As a result, as shown in FIG. 11, the hooking members 61 move downwards and under the releasing members 42, thereby being released from their locked state. Simultaneously, the engagement of the hooking members 61 and the stopping grooves 41 is released. Next, the protruding member 38 provided on the lever 30 is pressed and, as shown in FIG. 10, the resilient locking member 35 changes shape and bends, thereby releasing the stopping protrusion 40 and the lever stopping member 14 from their latched state. After the lever 30 has been released from its regulated state in this manner, the lever 30 is rotated in a direction opposite to the direction shown by the arrow A of FIG. 1. When this is done, the follower pins 12 of the female housing 10 are moved from the state shown in FIG. 8 along the cam grooves 34 as the lever 30 is being pivoted. The two housings 10 and 20 are moved in a direction of separation, as shown in FIG. 7, and the fitted state is released.

The embodiment described above has a configuration whereby the regulation of movement in an anterior direction of the detecting member 50 is released only when the lever 30 has been pivoted to the final position. As a result, the movement or lack of movement of the detecting member 50 allows one to detect whether the fitting state of the connector is correct. Moreover, when the lever 30 is located in the final position, the stopping protrusion 40 and the lever stopping member 14 of the female housing 10 are in a mutually engaged state, and the stopping grooves 41 and the hooking member 61 of the detecting member 50 are in a mutually engaged state, thereby doubly preventing the lever 30 from being pivoted in a returning direction.

Figure 14:
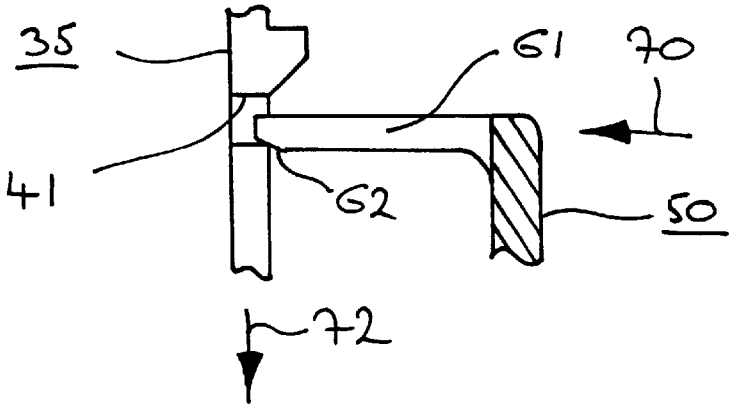
FIG. 14 is a partial cross-sectional view of the lever and detecting member.

If by some manufacturing error any of the components exceed the permitted tolerance, the engagement of the stopping member 60 of the arms 59 with the regulating members 18 may be released before the lever 30 has been locked in the correct position. If this were to occur, the detecting member 50 could be pushed in an anterior direction even though the two housings 10 and 20 were in a half-fitted state and the lever 30 not in the correct position. However, as shown in FIG. 14, when the detecting member 50 is pushed in at this juncture (indicated by arrow 70), anterior end portions of the guiding members 62 formed on the hooking members 61 of the detecting member 50 collide with the stopping grooves 41 of the resilient locking member 35. Consequently, the guiding members 62 guide the lever 30 to the correct position (indicated by arrow 72) as the detecting member 50 is being pushed in.

By this means, one can be certain that the two housings 10 and 20 will reach a completely fitted state.

The present invention is not limited to the embodiments described above with the aid of figures. For example, the possibilities described below also lie within the technical range of the present invention. In addition, the present invention may be embodied in various other ways without deviating from the scope thereof.

(1) In contrast to the embodiment described above, the lever may be provided on the female housing and the detecting member on the male housing.

(2) Furthermore, the lever and the detecting member may be provided on the same housing, whether this be the male or the female housing.

(3) The stopping protrusion of the resilient locking member and the lever stopping member need not be provided as the regulating means for preventing the lever from pivoting in a returning direction. Instead, the regulating means may consist of the engagement of the hooking members of the detecting member and the stopping grooves.

(4) In the embodiment described above the guiding members are provided on the hooking members. However, both the guiding members and the hooking members may be provided in differing locations.

(5) Furthermore, in the embodiment described above, the lever stopping member for latching the lever is provided on the female housing, whereas the lever is provided on the male housing. However, according to the present invention, a latching means such as the lever stopping member may equally well be provided on the same housing as the lever.

What is claimed is:

1. A electrical connector comprising:

male and female connector housings adapted for mutual engagement, one of the connector housings having a lever engageable with the other connector housing and latchable thereto by first latch means provided on the housings, said lever being pivotable from an open to a closed position to draw said housings together, wherein one of said housings further includes a detecting member movable thereon from a first position to a second position, said detecting member having a resilient arm engageable with an abutment of said one of said housings in an open condition of said lever, said lever further including a releasing member adapted to bend said resilient arm in the closed position of said lever, thereby to release engagement of said arm and abutment and to permit movement of said detecting member to the second position, and said detecting member further including second latch means for latching the housings together in addition to the first latch means, said second latch means being engageable with said lever in the closed condition and only in the second position of said detecting member.

2. An electrical connector according to claim 1 wherein said detecting member has a resilient arm on each side thereof, and said one of said housings has an abutment for each resilient arm.

3. An electrical connector according to claim 1 wherein said detecting member protrudes from said one of said housings in the first position.

4. An electrical connector according to claim 3 wherein said detecting member has a resilient arm on each side thereof, and said one of said housings has an abutment for each resilient arm.

5. An electrical connector according to claim 1 wherein said second latch means comprises a protrusion and said lever further includes a recess for engagement therewith.

6. An electrical connector according to claim 5, characterized in that said protrusion has a tapered guiding surface adapted to guide the projection into engagement with the recess of the lever.

7. An electrical connector according to claim 5 wherein said protrusion extends in the direction of movement of said detecting member.

8. An electrical connector according to claim 7, characterized in that said projection has tapered guiding surface adapted to guide the projection into engagement with the recess of the lever.

9. An electrical connector according to claim 1 and further including a releasable resilient latch adapted to retain said detecting member in the second position.

10. An electrical connector according to claim 9 wherein said resilient latch comprises a protrusion of said housings and said flexible arm of said detecting member.

* * * * *